US005109661A

United States Patent [19]

Okamoto et al.

[11] Patent Number: 5,109,661

[45] Date of Patent: May 5, 1992

[54] STEEL CORD FOR REINFORCING RUBBER

[75] Inventors: Kenichi Okamoto; Hidekazu Nakata, both of Itami, Japan

[73] Assignee: Sumitomo Electric Industries, Ltd., Osaka, Japan

[21] Appl. No.: 491,904

[22] Filed: Mar. 12, 1990

[30] Foreign Application Priority Data

Mar. 15, 1989 [JP] Japan ..... 1-64835

[51] Int. Cl.[5] ..... D02G 3/36; B60C 9/00

[52] U.S. Cl. ..... 57/212; 57/210; 57/232; 57/902; 152/451

[58] Field of Search ..... 57/210, 212, 223, 232, 57/234, 258, 207, 200, 902; 152/451

[56] References Cited

U.S. PATENT DOCUMENTS 4,506,500 3/1985 Miyauchi et al. ..... 57/212
4,709,544 12/1987 Charvet ..... 152/451 X
4,966,216 10/1990 Kawasaki et al. ..... 152/451 X

FOREIGN PATENT DOCUMENTS 60-189604 9/1985 Japan .
61-63792 4/1986 Japan .
62-96104 5/1987 Japan .

*Primary Examiner*—Daniel P. Stodola
*Assistant Examiner*—William Stryjewski
*Attorney, Agent, or Firm*—Armstrong, Nikaido, Marmelstein, Kubovcik & Murray

[57] ABSTRACT

An improved steel cord for reinforcing rubber is formed of three steel filaments, one having a smaller diameter than the other two, twisted together. The thinner filament is twisted with the two filaments at least partially in contact with them and with the same pitch. When the steel cord is cut at both ends, the thinner filament is retracted inwardly from the ends of the two filaments. This improves the penetration of rubber into the cord and prevents edge separation.

4 Claims, 3 Drawing Sheets

STEEL CORD FOR REINFORCING RUBBER

The present invention relates to a steel cord for reinforcing a reinforcing fiber in a rubber structure such as an automobile tire and a conveyor belt, and particularly to a steel cord which exhibits an excellent effect if used to reinforce a belt of a radial tire.

The characteristics required for a steel cord used to reinforce the belt of a radial tire includes the adhesion to rubber, the adhesion durability, the corrosion resistance to water, various mechanical performances (such as breaking load, rigidity, fatigue resistance and flexibility). The corrosion resistance largely depends on the degree of penetration of rubber into the cord. If there is a space not penetrated by rubber in the cord, the rubber of the tire may get damaged during use and such a damage may enlarge, thus allowing infiltration of water into the cord through the damaged portion. This will cause corrosion inside the cord, thus lowering its breaking load and fatigue resistance.

In order to improve the penetration of rubber, an open cord having a 1×3, 1×4 or 1×5 twisting construction and a 2 +2 twisting construction have been proposed. But the former has a problem that because the cord is subject to elongation even under a low tensile force during the calendering step in the manufacture of a tire in which cords are drawn for alignment, its filaments tend to be drawn close to one another. The cord thus made tends to be a closed cord which does not permit a sufficient penetration of rubber. Also it is difficult to keep uniform the distances between the adjacent cords when drawing them for alignment.

On the other hand, the latter has a good rubber penetration. But because its cross-sections at different parts in the longitudinal direction are not circular but irregular, its fatigue properties are extremely low.

It is disclosed in some conventional techniques to twist filaments having different diameters from each other to further improve the penetration of rubber. Such cords are disclosed in Japanese Unexamined Patent Publications 60-189604, 61-63792 (GB 8418509) and 62-96104.

Also it is recently required that a steel cord has a simple twist construction for lower cost and is light in weight to produce a light-weight tire and thus to reduce the fuel consumption. There are various cords proposed to satisfy such requirements, such as a 1×2 HT (high-tensile) cord (U.S. Pat. No. 798652), which shows a good penetration of rubber.

Among the above-described various cords, the open cords and the 2+2 cord have the problems described above.

On the other hand, conventional strands made of filaments having different diameters from each other have a good penetration of rubber into the cord. But, as described in Japanese Unexamined Patent Publication 60-189604, because of many irregularities on the surface of the cord, not only is it necessary to use a large amount of rubber but also quality problems may arise during the calendering step in the manufacture. Further in any of the three prior art cords, the ratio of the diameter of small-diameter filaments to that of large-diameter filaments has a lower limit which is rather large, i.e. 0.60–0.75. It would be possible to improve the rubber penetration by lowering this ratio. But this will make the manufacturing process more difficult. Experiments have revealed that by twisting filaments having different diameters together, a twisting strain in a direction opposite to the direction of twist remains in the filaments having a smaller diameter; and when the cord ends are freed, the residual strain is released to cause the small-diameter filaments to come loose from the cord. The smaller the above said diameter ratio, the more remarkable the degree of such loosening or scattering resulting from this residual strain.

It is necessary for the 1×2 HT cord having a simplified twisting construction to increase the diameter or tensile strength of filaments in order to assure a high breaking load. But, an increase in the diameter of filaments will bring about lowering of the fatigue properties of the cord and thus has its limit. This leaves only the latter method as a feasible one. But, an increase in the tensile strength of filaments tends to lead to a reduction in the elongation speed and an increase in the possibility of breakage of filaments during stranding owing to a decrease in the toughness, thus lowering productivity.

It is an object of the present invention to provide a steel cord for reinforcing rubber which obviates the abovesaid shortcomings.

According to the present invention, in order to solve the above problems, there is provided a steel cord comprising three steel filaments having surface thereof brass-plated as shown in FIG. 1. Of the three steel filaments 1–3, two have the same diameter and one has a smaller one.

By twisting them with the large-diameter filaments in contact with each other, the small-diameter filament 3 is adapted to keep an internal stress which will be released when the cord is cut at both ends thereof so that before both ends are cut and the residual stress is released, the diameter of the cord (Dco) will be kept within the range from the same level (1.00-fold) as the diameter Ds of the strand formed of two large-diameter filaments (the diameter of the circumscribed circle) to 1.15-fold thereof as shown in FIG. 5*a*, and after both ends of the cord are cut, the diameter $Dc_1$ of the cord (FIG. 5*b*) will increase to such a range from the same level as Ds up to 1.45-fold of Ds.

After the cord has been cut at both ends thereof, owing to the release of internal stress, the ends of the small-diameter filament 3 will retract inwardly from the ends of the large-diameter filaments 1 and 2 as shown in FIG. 3.

It is preferable to set the diameters of the three steel filaments to 0.10 mm–0.40 mm and set the diameter of the small-diameter filament to 0.51- to 0.67-fold of the diameter of the large-diameter filaments or to set the elongation (%) of cord under the load of 0 to 2 kg within the range of 0.08–0.14 for the reasons to be set forth below.

With the above-described steel cord according to the present invention, because the internal stress in the small-diameter filament is not released during the period ranging from the twisting step to the calendering step, where the cord is wound on a reel as a product, there are not so many circumferential irregularities on a cross-section thereof as is apparent from FIGS. 1 and 2. On the other hand, when the cord has been made into a composite structure with rubber (when it is unwound from the reel and cut at both ends), the internal stress imparted to the small-diameter filament is released. This increases the diameter of the cord and forms suitable degree of irregularities on the outer periphery thereof as shown in FIGS. 3 and 4. Thus the rubber penetration improves. At this time, the ends of the small-diameter filament will retract inwardly from the ends of the large-diameter filaments, making the ends of the cord uneven. This will effectively prevent edge separation between the cord and the rubber starting from the cut ends of the cord.

The preferred ranges of various values are set for the following reasons.

As described above, in order to keep the irregularities on the outer periphery of the cord to a minimum till the calendering step and to increase the irregularities after the cord has been cut at both ends, it is necessary to impart an internal stress to some of the steel filaments forming the steel cord beforehand so that when its ends are freed by cutting, the stress will be released and the cord expand outwardly.

The present inventors have sought the method therefor. As a result it was found that the above object can be attained by preparing a filament having a smaller diameter than the other filaments, and twisting them together after giving a large preshaping to the small-diameter filament.

The less the number of filaments forming a steel cord, the less the cost of twisting. But, if the cord is formed of two filaments, the large-diameter filament used with the small-diameter filament has to have a diameter of more than 0.41 mm to assure a breaking load (usually more than 41 kgf). This will pose problems about the fatigue properties. If the tensile force is increased as another method, the reduction in productivity will result. Thus, the number of steel filaments forming the cord has been set to three.

The diameters of the steel filaments should preferably be 0.10–0.40 mm. The upper limit was determined in view of the decrease in the fatigue properties and the lower limit was determined in view of increase in cost. Within this range, two large-diameter filaments having the same diameter and one small-diameter filament should be used in view of efficiency.

In combining one small-diameter filament and two large-diameter filaments, their diameter ratio was changed to various values within the above diameter range to seek the conditions where the ends of the small-diameter filament are retracted inwardly from the ends of the large-diameter filaments. As a result, it was found that the diameter of the small-diameter filaments should be 0.51–0.67 time that of the large-diameter filaments. If the ratio is less than 0.51, the provision of the small-diameter filament will be meaningless. In other words, such a strand would be almost the same as the strand formed by two filaments. If the ratio is over 0.67, the internal stress kept in the small-diameter filament will not be enough for the small-diameter filament to be retracted sufficiently when the cord is cut at both ends. This will make it difficult to attain the desired object.

In twisting steel filaments having different diameters from each other, it is necessary to preshape the small-diameter filament so that it has the same or slightly longer twisting length than that of the large-diameter filaments. Otherwise, the tension applied to the cord would concentrate on the small-diameter filament during the twisting step, thus causing premature breakage of it.

But if the small-diameter filament is preformed excessively, the irregularities on the outer periphery of the cord will be excessively large. As a result the small-diameter filament may be damaged on its surface in the twisting or calendering step. This will lower the adhesion to rubber owing to the peeling of plating. Thus it is necessary to limit the size of irregularities on the surface of the steel cord by controlling the diameter of the cord.

Thus a tensile test of the steel cord was conducted and the damage on the filaments twisted together was observed. As a result, it was found out that the diameter of cord while it is fixed at both ends (which corresponds to the state from the twisting step till the calendering step) should be 1–1.15 times the diameter Ds of the circumscribed circle of the strand comprising two large-diameter filaments.

When both ends of the cord are freed (which corresponds to the state after bias-cutting), the stress of the small-diameter filament having an internal stress beforehand is released. Thus the filament expands outwardly so that the spaces formed between it and the large-diameter filaments will increase to a size suitable for rubber penetration. If these spaces increase excessively, the two large-diameter filaments and the small-diameter one might be separated from each other when vulcanized under pressure for the manufacture of a tire. As a result the cord will lose its function as a $1\times3$ cord. Therefore it is necessary to limit the size of these spaces. It was found as a result of experiments that the optimum range of the diameter of cord after having been cut at both ends is 1–1.45 times of Ds.

It is known that in an ordinary calendering step, the tension applied to the cord is about 2 kg whereas the elongation of a closed cord is 0.2 percent or less when subjected to the tension of 0 to 2 kg. Thus if the elongation under the load of 2 kg is less than 0.2 percent, it will become possible to avoid various troubles resulting from high initial elongation (that is, elongation under low load) such as the non-uniformity of distances between cords when they are drawn for alignment.

The cord according to the present invention appears to be an open cord from its cross-sectional view (FIG. 4). But because the two large-diameter filaments which receive most part of the load are twisted together so as to be always in close contact with each other, the elongation under the load of 2 kg is kept to less than 0.2% (ordinarily 0.08–0.14%), i.e. less than one-fourth of the elongation of an open cord (0.50–0.90%) as is apparent from FIG. 7. Thus there will be no trouble during the calendering step.

Also, as is apparent from FIG. 6, the elongation during use is small enough to reinforce a tire belt.

Other objects and features of the present invention will become apparent from the following description taken with reference to the accompanying drawings, in which:

FIG. 1 is a side view of the cord according to the present invention before being cut;

FIGS. 2*a*14 2*f* are cross-sectional views showing the portions corresponding to the identically numbered portions in FIG. 1;

FIG. 3 is a side view of the cord of FIG. 2 after having been cut at both ends;

FIGS. 4*a* to 4*f* are cross-sectional views of the portions corresponding to the identically numbered portions in FIG. 1;

FIGS. 5*a* and 5*b* are comparative views showing variations in the diameter of the cord before and after cutting;

EMBODIMENTS

Figure 1:
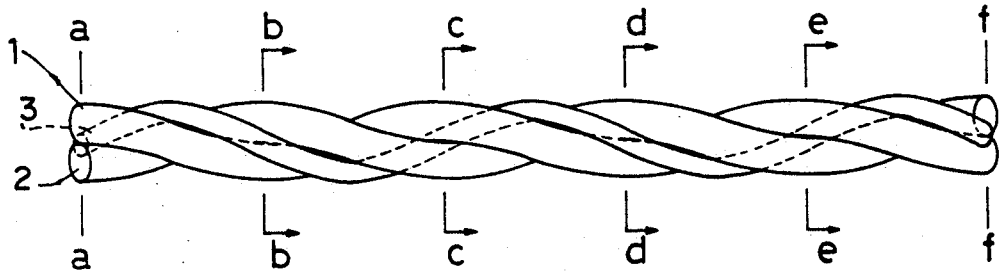
Figures 2A, 2B, 2C, 2D, 2E, 2F:
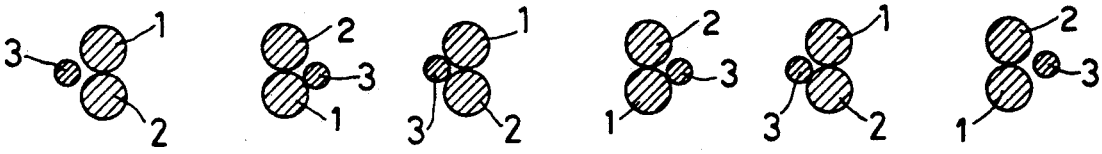
Figure 3:
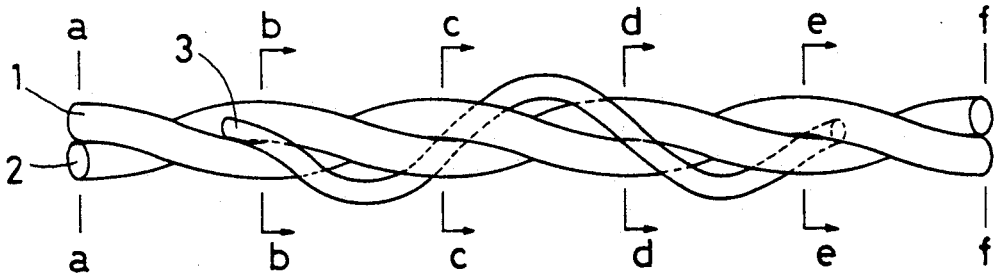
Figures 4A, 4B, 4C, 4D, 4E, 4F:
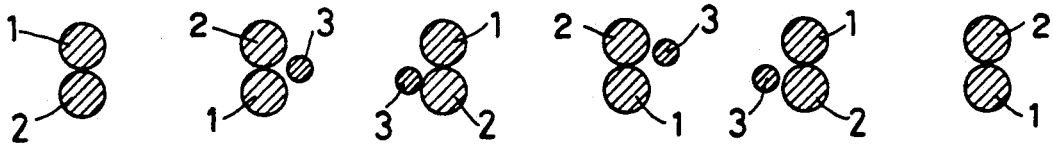
Figure 5A:
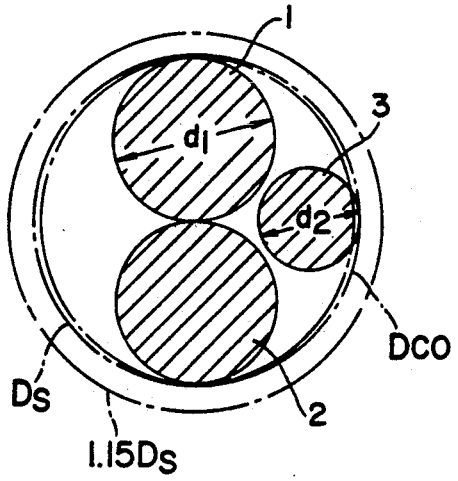
Figure 5B:
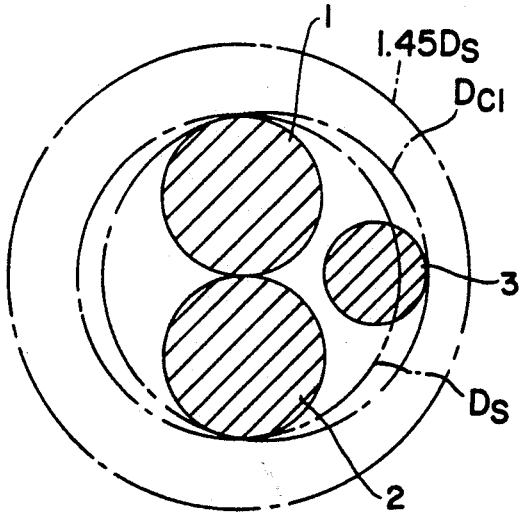
Figure 6:
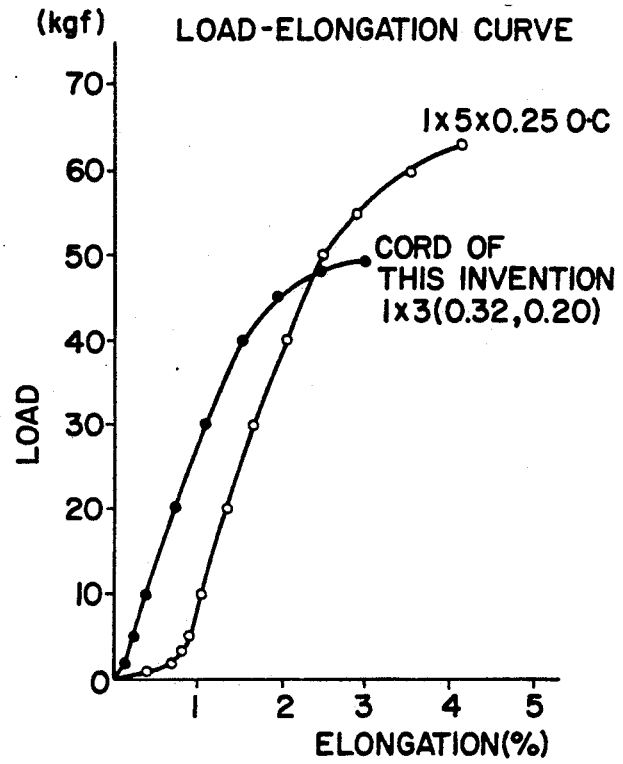
FIG. 6 is a graph showing the load-elongation properties.
Figure 7:
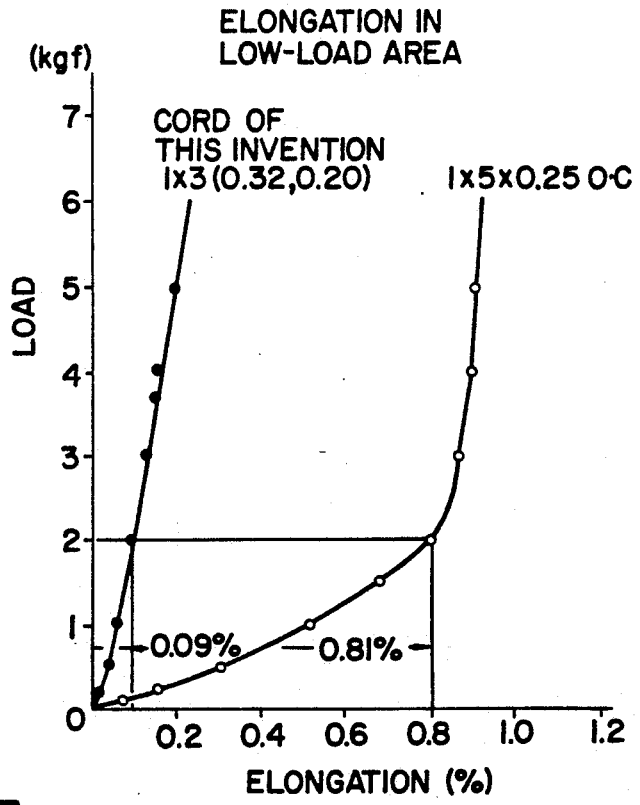
FIG. 7 is a graph showing the elongation within the low-load range.

Brass-plated steel filaments for a steel cord as shown in Tables 1 and 2 were prepared. The steel filaments in Table 1 were used as small-diameter filaments 3 shown in FIGS. 1 to 5 and the steel filaments shown in Table 2 were used as large-diameter filaments 1 and 2.

The steel filaments shown in the tables were combined to form steel cords according to this invention (embodiments 1–4) and comparative cords (comparative examples 1–8) as shown in Table 3. The twisting pitch was 14 mm for all the cords.

For each of these sample cords, which had been cut to the length L of 500 mm, the length after the small-diameter filament has become loose, the distance of its retraction from the ends of the cord and the rubber penetration were checked. The results, too, are shown in Table 3. As is apparent from this table, the embodiments 1–4 showed fine records in any of the evaluation items.

TABLE 1

| Mark | Diameter $d_2$ (mm) | Load at break (kgf) |
|---|---|---|
| S-1 | 0.12 | 3.3 |
| S-2 | 0.15 | 5.1 |
| S-3 | 0.17 | 6.6 |
| S-4 | 0.20 | 8.5 |
| S-5 | 0.22 | 10.3 |
| S-6 | 0.25 | 13.2 |

TABLE 2

| Mark | Diameter $d_1$ (mm) | Load at break (kgf) |
|---|---|---|
| L-1 | 0.30 | 19.6 |
| L-2 | 0.32 | 21.3 |

TABLE 3

| | Steel cord $1 \times 3$ ($d_1$, $d_2$) | Filament diameter ratio: $d_2/d_1$ | Load at break (kgf) | Cord diameter ratio: Before cutting $D_{co}/D_s$ | Cord diameter ratio: After cutting $D_{cl}/D_s$ | Evaluation of $1 \times 3$ ($d_1$, $d_2$) cord (Cut length L = 500 mm): *1 Length A (mm) | *2 Distance B (mm) | Rubber Penetration (%) | Total evaluation |
|---|---|---|---|---|---|---|---|---|---|
| Comp. EX. (1) | $1 \times 3$ (0.30, 0.12) | 0.40 | 37.8 | 1.00 | 1.51 | 220 | 28 | 100 | X |
| Comp. EX. (2) | $1 \times 3$ (0.30, 0.15) | 0.50 | 40.3 | 1.00 | 1.47 | 60 | 19 | 100 | Δ |
| EX. (1) | $1 \times 3$ (0.30, 0.17) | 0.57 | 42.7 | 1.01 | 1.43 | 15 | 10 | 100 | ○ |
| EX. (2) | $1 \times 3$ (0.30, 0.20) | 0.67 | 45.4 | 1.07 | 1.41 | 10 | 6 | 90 | ○ |
| Comp. EX. (3) | $1 \times 3$ (0.30, 0.22) | 0.73 | 47.3 | 1.16 | 1.36 | 7 | 2 | 50 | Δ |
| Comp. EX. (4) | $1 \times 3$ (0.30, 0.25) | 0.83 | 50.3 | 1.28 | 1.32 | 3 | 1 | 20 | X |
| Comp. EX. (5) | $1 \times 3$ (0.32, 0.12) | 0.38 | 40.4 | 1.00 | 1.58 | 240 | 32 | 100 | X |
| Comp. EX. (6) | $1 \times 3$ (0.32, 0.15) | 0.47 | 43.4 | 1.00 | 1.52 | 70 | 20 | 100 | X |
| EX. (3) | $1 \times 3$ (0.32, 0.17) | 0.53 | 46.2 | 1.00 | 1.44 | 18 | 11 | 100 | ○ |
| EX. (4) | $1 \times 3$ (0.32, 0.20) | 0.63 | 49.0 | 1.06 | 1.40 | 12 | 8 | 90 | ○ |
| Comp. EX. (7) | $1 \times 3$ (0.32, 0.22) | 0.69 | 51.0 | 1.12 | 1.36 | 9 | 4 | 60 | Δ |
| Comp. EX. (8) | $1 \times 3$ (0.32, 0.25) | 0.78 | 54.1 | 1.18 | 1.25 | 4 | 1 | 30 | X |

*1 Length for which thinner filament has gotten loose away from the cord
*2 Distance for which thinner filament has retracted from the ends of cord

What is claimed is:

1. A steel cord for reinforcing rubber comprising three brass-plated steel filaments twisted together, characterized in that two of said steel filaments have the same diameter and are twisted in contact with each other, the remaining one of said steel filaments has a smaller diameter than said two filaments and is twisted with said two filaments at least partially in contact with said two filaments and with the same twist pitch as said two filaments, said smaller diameter filament, when said filaments are so twisted, having a residual twist strain opposite to the direction of twist larger than the twist strain in said two filaments having the same diameter so that when said steel cord is cut at both ends thereof, the cut ends of said one steel filament having a smaller diameter retracts inwardly from the cut ends of said two steel filaments having the same diameter, so that the diameter of the steel cord will be expressed as follows:

$$Ds \leqq Dc_1 \leqq 1.45\ Ds$$

wherein

Ds = Diameter of the strand formed by said two steel filaments, and $Dc_1$ = Diameter of the steel cord after cut at both ends thereof.

2. A steel cord as claimed in claim 1, wherein the diameter of said three steel filaments is 0.10 to 0.40 millimeter and the diameter of said steel filament having a smaller diameter is 0.51 to 0.67 times that of said two steel filaments.

3. A steel cord as claimed in claim 1, wherein the elongation $\epsilon$ (%) of the steel cord under the load of 0 to 2 kg is as expressed below:

$$0.08 \leqq \epsilon \leqq 0.14$$

4. A composite rubber material comprising rubber and steel cord as claimed in claim 1, said steel cord being cut to predetermined lengths and embedded as a reinforcing material in said rubber with the ends of said one of said steel filaments, having said smaller diameter than said two steel filaments, retracted inwardly from the ends of said two steel filaments.

* * * * *